US005616046A

United States Patent [19]

Sundstrom et al.

[11] Patent Number: 5,616,046

[45] Date of Patent: Apr. 1, 1997

[54] CONNECTION DEVICE FOR SECURING TWO ENGAGED MEMBERS

[75] Inventors: Robert A. Sundstrom; Donald R. Dumont, both of Hudson, N.H.

[73] Assignee: Lynx Enterprises, Inc., Nashua, N.H.

[21] Appl. No.: 387,826

[22] PCT Filed: Sep. 7, 1993

[86] PCT No.: PCT/US93/08381

§ 371 Date: Feb. 21, 1995

§ 102(e) Date: Feb. 21, 1995

[87] PCT Pub. No.: WO94/06175

PCT Pub. Date: Mar. 17, 1994

[51] Int. Cl.[6] ..... H01R 13/62

[52] U.S. Cl. ..... 439/367; 439/370

[58] Field of Search ..... 439/367, 369–371, 439/373, 521, 523, 535, 536, 651, 652; 174/67; 29/235, 237, 450

[56] References Cited

U.S. PATENT DOCUMENTS

| | | | |
|---|---|---|---|
| 2,038,840 | 4/1936 | Hall . | |
| 2,716,225 | 8/1955 | McCubbin . | |
| 2,840,896 | 7/1958 | Thompson, Jr. . | |
| 3,059,209 | 10/1962 | Bird . | |
| 3,159,446 | 12/1964 | Protzmann . | |
| 3,571,782 | 3/1971 | Colbert . | |
| 4,180,303 | 12/1979 | Damsky . | |
| 4,185,375 | 1/1980 | Brown . | |
| 4,531,800 | 7/1985 | Avener . | |
| 4,944,685 | 7/1990 | Schulte . | |
| 5,074,023 | 12/1991 | Decker et al. . | |
| 5,080,598 | 1/1992 | Shotey . | |
| 5,147,216 | 9/1992 | Shotey . | |
| 5,180,197 | 1/1993 | Thompson, Jr. . | |
| 5,217,387 | 6/1993 | Hull et al. . | |
| 5,397,243 | 3/1995 | MacMurdo, Sr. | 439/373 X |
| 5,401,184 | 3/1995 | Sundstrom et al. | 439/373 X |

FOREIGN PATENT DOCUMENTS

| | | |
|---|---|---|
| 0715611 | 1/1942 | Germany . |
| 0083033 | 4/1920 | Switzerland . |
| 1469998 | 4/1977 | United Kingdom . |
| 1544597 | 4/1979 | United Kingdom . |
| 2099638 | 12/1982 | United Kingdom . |

*Primary Examiner*—Khiem Nguyen
*Attorney, Agent, or Firm*—Davis and Bujold

[57] ABSTRACT

A method for achieving a substantially waterproof connection between first and second parts using a resilient elongate tubular member formed from a single unitary piece of a substantially water impermeable material. The elongate tubular member has first and second opposed open ends. Once the first part is coupled to the second part, the tubular member rolled, from its donut configuration, from one of the parts toward the other part so that the first end encompasses a portion of one of the parts and the second end encompasses a portion of the other part whereby abutting surfaces of the first and second parts are completely encompassed by the tubular member to minimize penetration of a liquid between the tubular member and the first and second parts to achieve a substantially waterproof engagement therebetween. When it is desired to disconnect the first part from the second part, one end of the tubular member is rolled from one of the parts toward the other part so that the tubular member is again rolled up into a single donut configuration and directly supported by only one of the parts.

13 Claims, 8 Drawing Sheets

CONNECTION DEVICE FOR SECURING TWO ENGAGED MEMBERS

The present invention relates to a tubular member which is capable of encasing two interconnect members, such as a male electrical member (plug) with an electrical outlet, and minimizing penetration of liquid or moisture between the interconnected members to achieve a substantially waterproof connection. The tubular member also functions to maintain the two interconnected members in engagement with one another.

BACKGROUND OF THE INVENTION

A variety of such connection devices are known in the art but such known devices are generally cumbersome to utilize and are not particularly adapted for maintaining a substantially waterproof connection between the two interconnect members.

Further, when a male electrical member is connected to an electrical outlet, it is readily disconnected from the electrical outlet when the electrical cord, to which the male electrical member is connected, is accidently tripped over or tugged at to create a disconnecting force away from the electrical outlet.

SUMMARY OF THE INVENTION

Wherefore, it is a primary object of the invention to provide a tubular member for providing a substantially waterproof engagement between two interconnected engaged members and to prevent disconnection of those two members in the event that a force, tending to dislodge the two interconnected members, is applied.

Another object of the invention is to provide a tubular member which is relatively simple and inexpensive to manufacture and relatively easy to employ.

A further object of the invention is to provide a tubular member which is durable yet relatively flexible so that the tubular member has an extended operating life.

A still further object of the invention is to provide a tubular member which is substantially impermeable to liquid and moisture to reduce the possibility of an electrical short occurring between two interconnected electrical members when the tubular member is employed in an outdoor environment.

A still further object of the invention is to provide a reinforced tubular member which minimizes the axial stretch thereof to minimize the possibility of the two members from becoming disconnected from one another.

Another object of the invention is to provide a face plate for an electrical outlet with a supporting surface, for supporting the tubular member, for maintaining an electrical connection between a male connecting member of an electrical device and the electrical outlet.

Briefly, the present invention relates to a resilient elongate tubular member, formed from a single unitary piece of a substantially water impermeable material, for encasing two interconnected members which together define, when interconnected, an intermediate portion of greater cross section than two opposed end portions of the interconnected members, said elongate tubular member having opposed open first and second ends; a first portion being located adjacent the first opposed end and being dimensioned to encase and closely receive one of the opposed end portions of the interconnected members, and a second portion, serially arranged with said first portion, being dimensioned to be roll over the intermediate portion of two interconnected members and be resiliently expanded, when rolled thereover, to minimize penetration of liquid between the tubular member and the intermediate portion to achieve a substantially waterproof engagement therebetween; and said tubular member having a plurality of axially extending and spaced apart reinforcing means for minimizing axial stretch of said tubular member when a disconnecting force is applied thereto.

The present invention further relates to an electrical outlet receptacle adaptor comprising opening means for providing for an electrical connection between a plug and a receptacle of an electrical outlet; and said opening means being encompassed by a boss having an exterior surface, a first end of the exterior surface of the boss being configured to be encased by a resilient waterproofing tubular member and a second end thereof preventing liquid from accessing the plug, when engaged with said opening means. The present invention also relates to a face plate or electrical outlet an incorporating the same.

The present invention further relates to a method of achieving a substantially waterproof connection between a plug and a receptacle of an electrical outlet via an electrical outlet receptacle adaptor comprising opening means for providing for an electrical connection between the plug and the receptacle of an electrical outlet; and said opening means being encompassed by a boss having an exterior surface, a first end of the exterior surface of the boss being configured to be encased by a resilient waterproofing tubular member and a second end thereof preventing liquid from accessing the plug, when engaged with said opening means; said method comprising the steps of forming an electrical connection between the plug and a receptacle via said opening means; and encompassing said boss and the plug with the resilient waterproofing tubular member to form a substantial water connection therebetween.

BRIEF DESCRIPTION OF THE DRAWINGS

The above and other objects of the invention will be further understood by having reference to the accompanying drawings which illustrate, by way of example, preferred embodiments of the invention, in which.

DESCRIPTION OF THE PREFERRED EMBODIMENTS

Figure 1A:
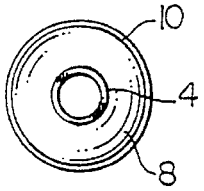
FIG. 1A is a diagrammatic left end elevational view of a tubular member shown in FIG. 1.

Turning now to FIGS. 1–5 of the drawings, the device for achieving a substantial waterproof connection between two interconnected engaged members will now be described in detail. The device comprises an elongate hollow tubular member 2 defining a central longitudinal axis L. The tubular member 2 has a first portion 4 located adjacent a first open axial end 5 thereof and a second portion 6 located adjacent an opposite second open axial end 7 of the tubular member. A lip 10 is provided adjacent the second open end of the tubular member to assist with rolling of the tubular member. The tubular member 2 is manufactured from a material substantially impermeable to liquid and/or moisture, such as vinyl plastisol, polyvinyl chloride, nitrile latex, rubber latex, acrylic latex, liquid neoprene, butyl rubber, thermoplastic rubber compound or elastomer, thermoset plastic, plastic, polypropylene, plasticizer, silicone, urethane or any combination of the above and has a thickness of from about 15 to 200 mils, having a Shore Hardness of between about 10A and 49A, and an axial length of from about 2.54–45.72 mm (1 to 18 inches). Other materials which have similar physical properties and characteristics may also be utilized. A low Shore Hardness allows a thicker wall for the tubular member, to increase wear resistence, while facilitating rolling and unrolling of the tubular member.

An important aspect of the present invention is that the material used to manufacture the tubular member must be sufficiently flexible to facilitate rolling of the tubular member into a rolled up "donut" shaped configuration (FIG. 8), the purpose of which will be explained in detail hereinafter, while maintaining the integrity, durability and reusability of the tubular member.

Figure 2:
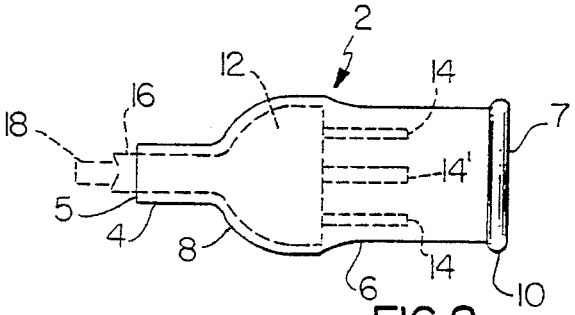
FIG. 2 is a diagrammatic representation of the tubular member of FIG. 1 with a conductor member shown in ghost.

FIG. 2 diagrammatically shows engagement of the tubular member 2 with a first (male) connector member 12. The first connector member 12 has two male contacts 14 and has a ground contact 14' projecting from a first end thereof. An opposite end of the first connector member 12 is connected to an outer casing 16 encasing transmission means 18, such as three electrical wires 20, interconnected with the contacts 14, 14'. The first portion 4 of the tubular member 2 is dimensioned to closely surround and encase the outer casing 16 (cord). The first portion 4 may intimately engage with the outer casing 16 to provide a substantially water tight seal between the first portion and the outer casing.

The second portion 6 is larger than the first portion but is dimensioned to be smaller than the outer dimension of the first connection member 12 so that the second portion 6 expands when the connection member 12 is encased by the second portion 6 of the tubular member 2.

Figure 1:
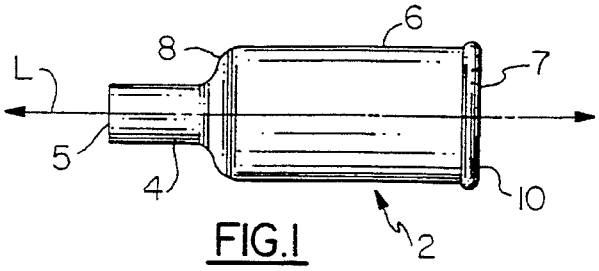
FIG. 1 is a diagrammatic front elevational view of a first embodiment of a tubular member according to the present invention.
Figure 3:
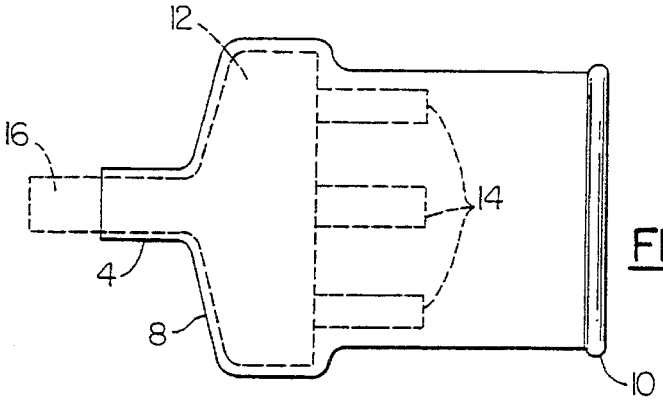
FIG. 3 is a diagrammatic representation showing a second embodiment of the tubular member with a conductor member shown in ghost.
Figure 4:
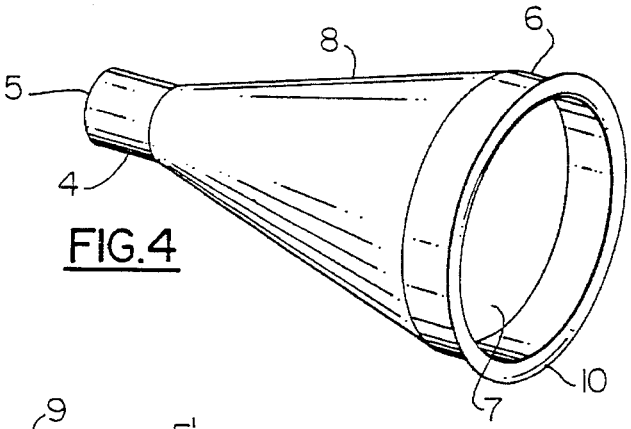
FIG. 4 is a diagrammatic perspective view of a third embodiment of the tubular member.

A transition 8 is formed between the first portion 4 and the second portion 6 of the tubular member. The transition 8 shown in FIGS. 1–3 is an integral curved, gradual transition while the transition shown in FIG. 4 is an integral tapered transition. It is to be appreciated that the transition can have any desired shape and/or configuration, depending upon the application at hand.

FIG. 3 shows a variant of the tubular member in which the first connector member 12 encased by the tubular member 2 is significantly larger, e.g. for a 220 volt electrical plug and cord. Accordingly, the dimensions of the first and second portions of the tubular member 2 are relatively larger but are still designed so that the first portion closely engages with the outer casing 16 while the second portion is expanded when the connection member 12 is encased thereby. It is to be appreciated that the dimensions of the first portion 4, the second portion 6 and the transition 8 located therebetween can vary depending upon the application. An important aspect of the present invention is that the second portion be in an circumferentially expanded condition, approximately 10 to 300 percent expanded, when the connection member 12 is encased therein, so that the second portion achieves a snug and substantially waterproof engagement between the second portion and the two connection members.

Figure 5:
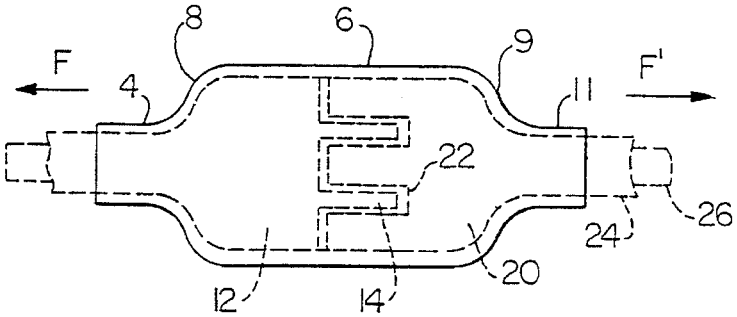
FIG. 5 is a diagrammatic representation showing a forth embodiment of the tubular member with two interconnected members shown in ghost.

FIG. 5 shows a fourth embodiment in which the tubular member further includes a third portion 11 located between the second portion 6 and the second opposed axial end 7 and a second transition 9 located between the third portion 11 and the second portion 6. The third portion 11 of the tubular member 2 is dimensioned to closely surround and encase the outer casing (cord) 24. In this embodiment, better waterproofing is achieved, especially if the third portion is sized to intimately engage with the outer casing 24 of the second conductor member 20. The second conductor member 20 has mating female recess (contacts) 22 connected to second transmission means 26.

Figure 6:
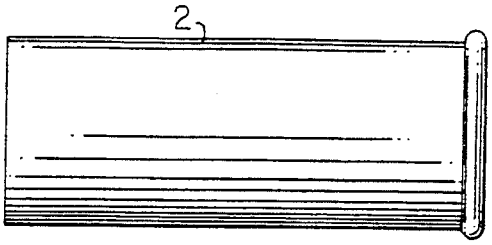
FIG. 6 is a diagrammatic front elevational view of a fifth embodiment of the tubular member.

FIG. 6 shows a fifth and preferred embodiment in which the entire tubular member is of the same dimension, i.e. the tubular member 2 comprises solely the second portion 6 which is dimensioned somewhat smaller than the outer dimensions of the connection members to be accommodated therein so that the second portion expands when the connector members are encased thereby.

Figure 6A:
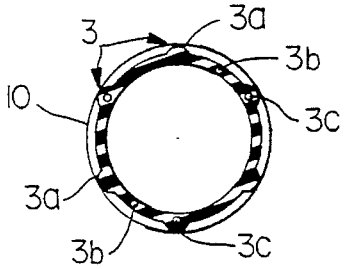
FIG. 6A is a diagrammatic cross sectional view of a sixth embodiment of the tubular member.

As can be seen in FIG. 6A, the tubular member is preferrably provided with a plurality of equally spaced axially extending reinforcing means 3, such as ribs 3*a*, embedded strands or embedded threads 3*b*, or both ribs reinforced with strands or threads 3*c*, etc. The ribs are areas which are reinforced by depositing additional material, in an axially extending direction, at desired locations of the exterior surface of the tubular member.

The strands or threads, accommodated within the sidewall of the tubular member or the ribs, can be either fiber glass monofilament, nylon, cotton, polyester, rayon, steel, aluminum, copper, brass, or other similar materials which axially strengthen the tubular member. The reinforcing means 3 are preferrably flexible while minimizing axial stretch of the tubular member when a disconnecting force F is applied to the tubular member. The reinforcing means, preferrably between one and four in number, are arrange not to hinder expansion and/or stretching of the tubular member in the direction perpendicular to the axial direction.

The reinforcing strands are either molded or embedded within the support ribs during production of the tubular member or they may be added to an existing tubular member 2 by applying the strands to an exterior surface of a tubular member and thereafter adding additional latex or another substance to adhesively secure the strand to the exterior surface of the tubular member.

Figure 7:
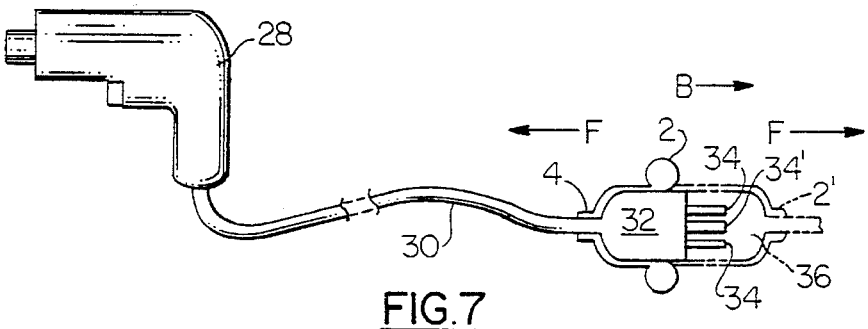
FIG. 7 is a diagrammatic representation showing the tubular member attached an electrical plug of an electrical tool.

Turning now to FIG. 7, one use of the tubular member of the present invention is diagrammatically shown. An electrical tool 28 is connected to one end of an electrical cord 30 while the opposite end of the electrical cord 30 is connected to a male electrical plug 32 having male contacts 34, 34'. As can be seen in this figure, the tubular member 2 is in a partially rolled up configuration in which the first portion 4 is in intimate engagement with an outer surface of the electrical cord 30 while a part of the second portion engages with the exterior surface of the male plug 32. The remainder of the second portion is in the rolled up condition to facilitate the use of the device, i.e. unrolling in the direction of arrow B, as will be explained below.

Once the male plug 32 is connected to a female electrical plug 36 of, for example, an extension cord (shown in ghost in FIG. 7), the device 2 is unrolled in the direction of arrow B into a substantially completely unrolled condition 2' (shown in ghost). Once in this unrolled condition 2', the inherent resiliency of the material from which the tubular member 2 is manufactured provides a substantially waterproof connection and assists with preventing undesired disconnection of the two interconnected members when a force F is applied substantially along the longitudinal axis of the mating plugs 32, 36 and tending to disconnect the two engaged plugs from one another. The tubular member, due to its material's inherent resiliency, absorbs any minor disconnection force(s) F and tends to draw the two connection members back into a proper engagement with one another, if the force F was significant enough to partially disconnect the two plug members from one another. It is to be appreciated that the amount of expansion undergone by the tubular member will effect the sealing and connection ability, i.e. the greater the expansion the greater the sealing force and the ability of the tubular member to prevent the two interconnected members from being disconnected from one another. Furthermore, as the tubular is manufactured from a material which is essentially impermeable to liquid and/or moisture, the possibility of an electrical short resulting from use of the tubular member in an outdoor environment is minimized.

Figure 8:
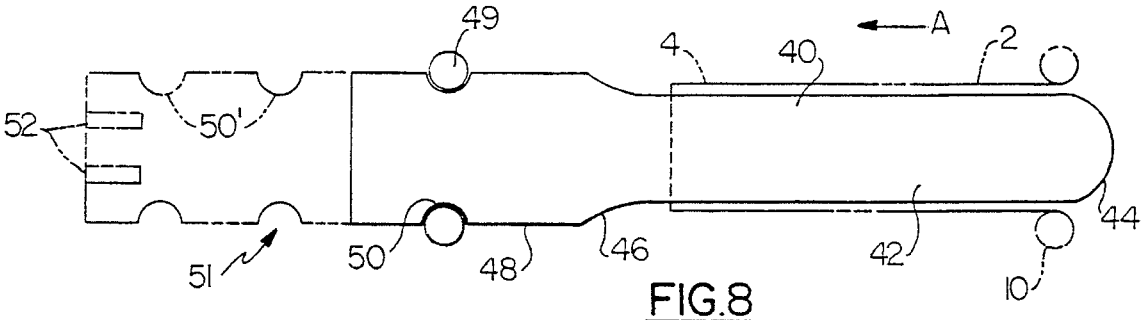
FIG. 8 is a diagrammatic representation showing an apparatus for facilitating rolling and transferring of the tubular member onto a desired member.
Figure 9:
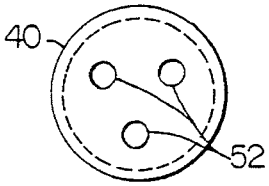
FIG. 9 is a diagrammatic left end elevational view of the apparatus shown in FIG. 8.
Figure 10:
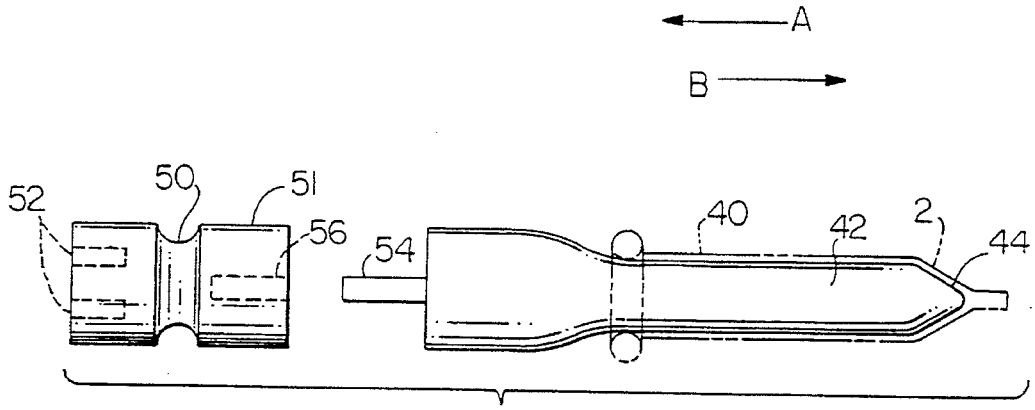
FIG. 10 is a diagrammatic representation of a second embodiment of an apparatus facilitating rolling and transferring of the tubular member onto a desired member.

Turning now to FIGS. 8 and 9, an apparatus for facilitating rolling of the tubular member into the "donut" configuration 49 and for transferring the tubular member to a desired connector member will now be described. The apparatus 40 comprises a metal, wooden or plastic elongate tubular portion 42 having an axial length substantially at least as long as the axial length of the tubular member to be rolled up. The tubular portion has an outer dimension substantially equal to the inner dimension of one of the first and second portions of the tubular member to be rolled up. The apparatus 40 has a first rounded end 44 to facilitate passing of the tubular member onto the apparatus 40. The first end 44 may also be tapered, if desired (FIG. 10). A spool 51 is formed integrally with the apparatus 40, opposite the first end 44, with a tapered portion 46 integrally formed between the elongate tubular portion 42 and the spool 51.

Figure 11:
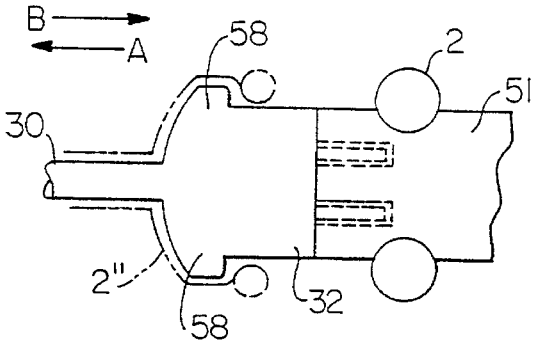
FIG. 11 is a diagrammatic representation showing the transfer of the tubular member from a spool onto a male electrical plug.

The spool 51 is an elongate cylindrical member having at least one annular recess 50 provided in an exterior surface thereof. As shown in ghost in FIG. 8, the axial length of the spool and the number of annular recesses 50 formed therein may be increased, as desired, to facilitate supporting a plurality of rolled up tubular members 2 thereon, e.g. the spool may have three annular recesses 50. A plurality of apertures 52 for engaging the male contacts or other protrusions of the male connector member are provided adjacent the spool end of the apparatus 42. Alternatively, a flat surface or a plurality of protrusions, for engaging female contacts of a female connector member to which the tubular member is to be applied, may be provided adjacent the spool end of the apparatus. The plurality of apertures 52, in use, receive the male contacts 34 of a male plug to provide abutting engagement between the spool 51 and the male plug 32 to facilitate transfer of the rolled up tubular member onto the male plug 32 (FIG. 11).

In order to roll up the tubular member, the tubular member 2 is first passed or slid onto the apparatus 40, the first portion 4 end first with the lip 10 being located adjacent the first end 44, the lip 10 is next rolled to the left, as shown by arrow A in FIG. 8, until the tubular member has been completely rolled up. Thereafter, further rolling movement of the tubular member toward the left occurs until the rolled up "donut" configuration tubular member 49 is accommodated within one of the annular recesses 50, where it is temporarily stored for later use.

The apparatus 40 shown in FIG. 10 is functionally equivalent to that shown in FIG. 8, but the rolling apparatus 40 and the spool 51 are formed as two separate components. In addition, the end of the apparatus, opposite the first end 44, has a protrusion 54 which engages with a mating recess 56, provided in the end of the spool 51 opposite the plurality of apertures 52, to facilitate proper alignment and engagement of the apparatus 40 with the spool 51. Other known interconnections between these two members may also be utilized.

As can be seen in FIG. 10, the tubular member 2 is inserted onto the apparatus 40 lip end first, i.e. the second portion 6 is accommodated by the tubular portion 42 and the first portion 4 is located adjacent the tapered end 44. As the tubular portion 42 is preferably sized to engage with an interior surface of the second portion, or slightly smaller, rolling in the direction of arrow B is facilitated. Once the tubular member is substantially completely rolled up, the tubular member is pulled off the rolling apparatus 40 and turned around and then rolled back onto the apparatus 40 in the direction of arrow A so that it may be rolled on to the spool 51, after the apparatus 42 is connected to the spool 51, via the mating protrusion and recess 54, 56.

It is important to note that when rolling the tubular member into a "donut" configuration 49, the lip end 10 must be rolled toward the first portion 4 so that the first portion 4 forms the exterior of the "donut" configuration, i.e. is the first part of the tubular member to be unrolled. Thus, when the tubular member is installed on a desired connector member, the first portion can be positioned adjacent the outer casing of the first connector member and be properly positioned.

The installation of tubular member 2, once rolled up, onto a desired connector member can be seen with reference to FIG. 11. Once the spool is properly engaged with the male plug 32, i.e. the male contacts 34 engaged with the plurality of apertures 52, the tubular member is rolled in the direction of arrow A over the male plug 32 onto the outer casing 30. Thereafter, the device is partially unrolled, i.e. rolled in the direction of arrow B, until the tubular member partially encases the connector member 32, as can be seen in ghost in FIG. 11, and ready for use. In order to assist with maintaining the tubular member in the partially unrolled condition shown in FIG. 11, the connector member 32 may be provided with opposed radially protrusions or a radially extending annular member 58 which aids with preventing the tubular member from being rolled in the direction of arrow A toward the second portion. The protrusion means 58 assists with maintaining the tubular member in a position for ready use, once installed.

Figure 12:
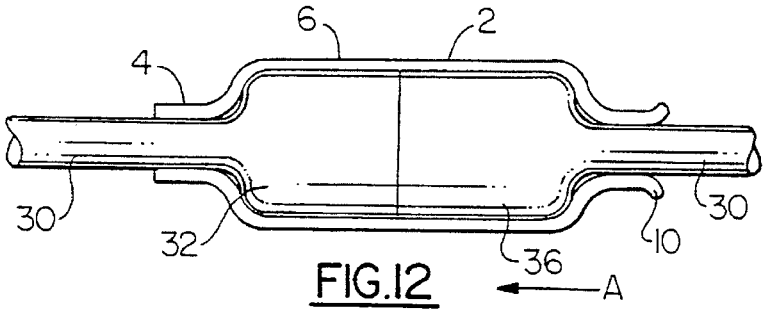
FIG. 12 is a diagrammatic representation showing the engagement between the tubular member of FIG. 1 and two interconnected members.
Figure 17:
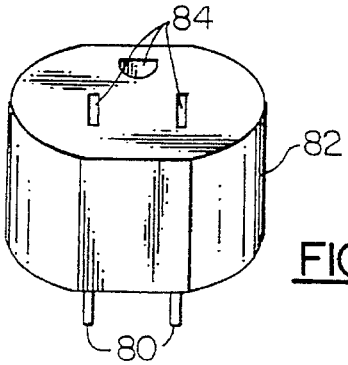
FIG. 17 is a diagrammatic perspective view of the intermediate member of FIG. 14.

When a mating female connection member, such as the female end of an extension cord, is brought into mating engagement with the electrical plug 32, the tubular member 2 is rolled in direction of arrow B until it encases a substantial portion of the female connection member and intimately engages and seals the outer surfaces of the interconnected male and female members (FIG. 12). Preferably, the second portion will entirely encase the second connector member as well as substantial part of the first connector member.

When disconnection of the two interconnected members is desired, the lip 10 is rolled in the direction of arrow A (FIG. 12) until the tubular member no longer engages the female member 36 and the tubular member is thus in a partially rolled up condition ready for further use. The female member can then be readily disconnected from the male connector member 32.

Figure 13A:
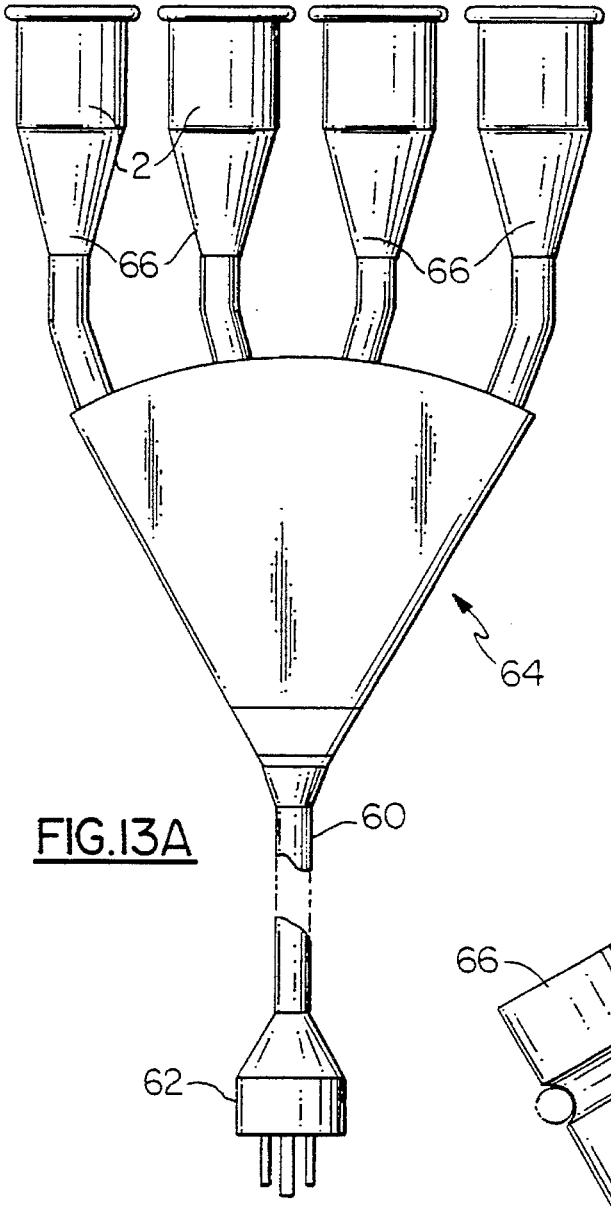
FIGS. 13A and 13B are diagrammatic representations showing two embodiments of an extension cord having a plurality of female electrical plug members.

Turning now to FIG. 13A, a further embodiment of the present invention can be seen. In this embodiment, an electrical extension cord 60 has a male plug 62 connected adjacent one end thereof and female connection means 64 connected adjacent the opposite end of the cord 60. The female connection means 64 branches into four separate female electrical plug members 66. Each female electrical plug member supports a partially rolled up tubular member 2. When a female electrical plug member 66 engages a male electrical plug member (not shown), the tubular member 2 is unrolled over the male electrical plug member to encase the two interconnected members. This arrangement is particularly useful at a construction site where more than one user may desire to be connected to an electrical power supply. In the event that a tubular member 2 is also supported by the male electrical plug member to be engaged with the female electrical plug member (e.g. FIG. 7), one of the tubular members is be rolled away from its associated connector member so that the other tubular member can be used to encase the two interconnected members.

Figure 13B:
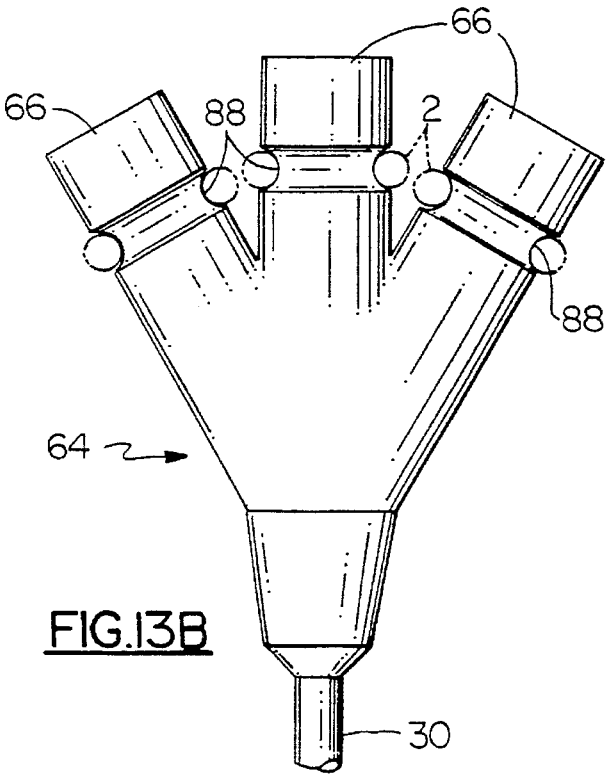

FIG. 13B shows a variation of the female connection means 64. In this embodiment, three female electrical plug members 66 are provided at one end of the extension cord. Each female electrical plug member 66 has an annular recess 88 formed in the exterior surface thereof. The annular recess 88 is provided for accommodating the tubular member 2, when in its rolled up "donut" configuration, and assisting with maintaining the two interconnected members in engagement with one another.

Turning now to FIGS. 14–18, a first embodiment of a face plate, according to the present invention, will now be discussed. The face plate 70 is a rectangular member and defines a plane P. The end plate 70 is secured to an electrical outlet 76 by attachment means 72, such as one or more screws engaging within an aperture 74 of the electrical outlet 76. The face plate 70 may either be a substantially planar member or may be slightly dome shaped, with a flat central portion, to accommodate two or more electrical receptacles 77 which protrudes slightly from an electrical outlet 76 mounted within a wall W. As such face plates are generally known in this art, further detailed discussion concerning the same is not provided herein. To ensure a waterproof connection between the face plate 70 and the electrical outlet 76, a perimeter seal 81 is provided therebetween.

Figure 16:
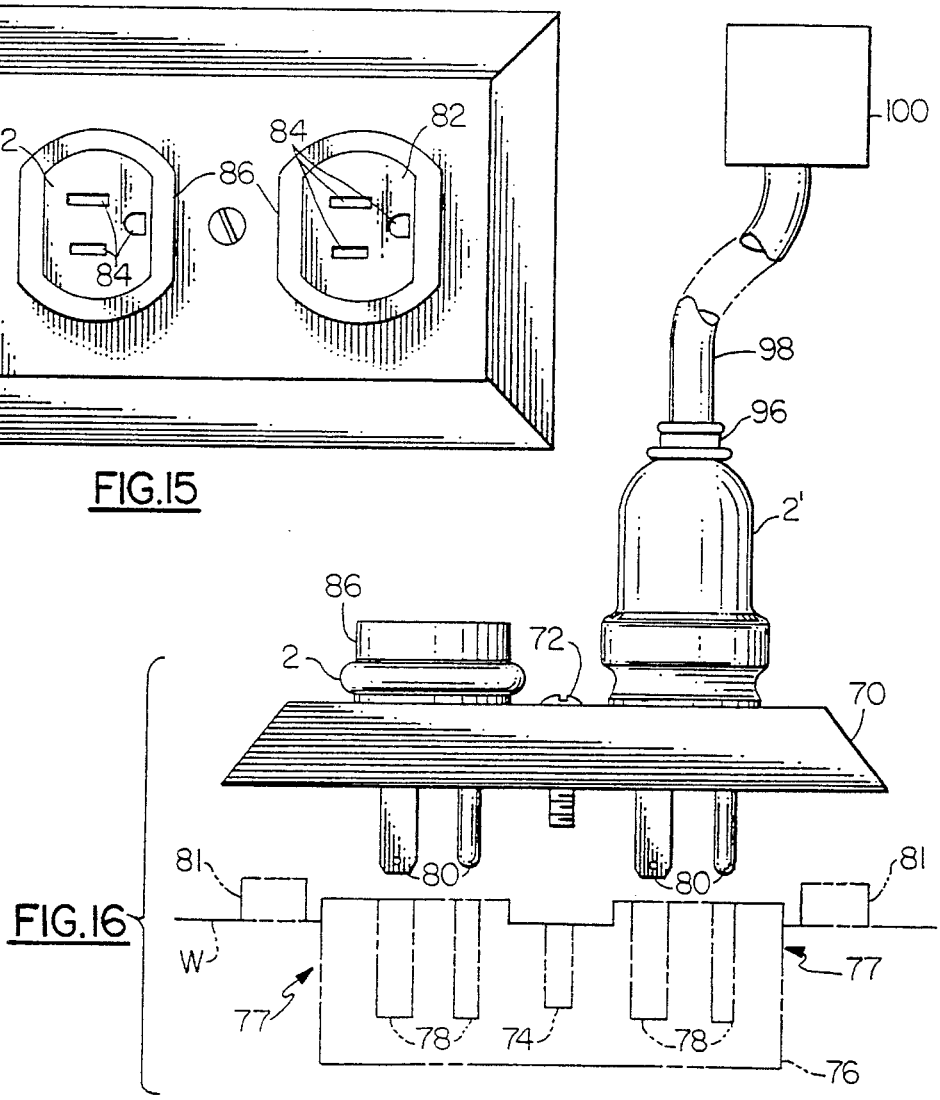
FIG. 16 diagrammatically shows operation of the face plate of FIG. 14.

As can be seen in FIG. 16, the electrical outlet 76 has two receptacles 77 which each contain a plurality of female contacts, i.e. generally two female contacts and one ground contact. Two bosses 86, each defining an axis A which extends substantially perpendicular to the plane P, extend from and are integral with a first planar surface of the face plate 70. Each boss 86 is generally cylindrical or oval in shape and is provided with an annular groove or circumferential recess 88 formed in an exterior surface of the boss. The purpose of the recess 88 is to accommodate the tubular member, when its in its rolled up configuration (FIG. 16). An insert member 82 is accommodated within each boss 86 and is made of an insulating or non-conductive material, such as ceramic. The insert member 82 supports a plurality of female contacts, i.e. two female contacts and one ground contact, on a surface thereof remote from the face plate and also supports a plurality of male contacts, i.e. two male contacts and a ground contact on an opposed surface thereof adjacent a second surface of the face plate. Each female contact 84 is directly wired or connected with a corresponding male contact 80 to form an electrical connection therebetween. The insert member 82 is very similar to the adapters which are presently available to adapt a three pronged grounded plug to a two pronged ungrounded receptacle. Accordingly, as such teaching is well known in the art, further discussion concerning the same is not provided herein.

The male contacts 80 project substantially perpendicularly from the second surface of the face plate 70 (FIG. 16) to facilitate engagement with the female contacts 78 of a desired receptacle 77. The insert member 82 is glued or otherwise permanently secured to an inner surface of the boss 86 to become integral therewith.

Once the face plate 70 is securely attached to an electrical outlet, via the attachment means (screw) 72, the female contacts 84 are positioned for engagement with male contacts of a desired electrical plug 96 (FIG. 16). Accordingly, when male contacts of a plug 96, connected to an electrical appliance or device 100 via an electrical cord 98, engage with the female contacts 84 of the intermediate member 82, an electrical connection with the electrical outlet 76 is achieved. In order to achieve a substantially water proof connection and/or minimize the possibility of the plug 96 becoming unintentionally disconnected from the electrical outlet 76, the tubular member 2 is unrolled from recess 88 over the exterior surfaces of the boss 86 and the plug 96. Once the tubular member is in this unrolled condition 2' a disconnecting force F will be substantially absorbed by the tubular member 2.

Figure 14:
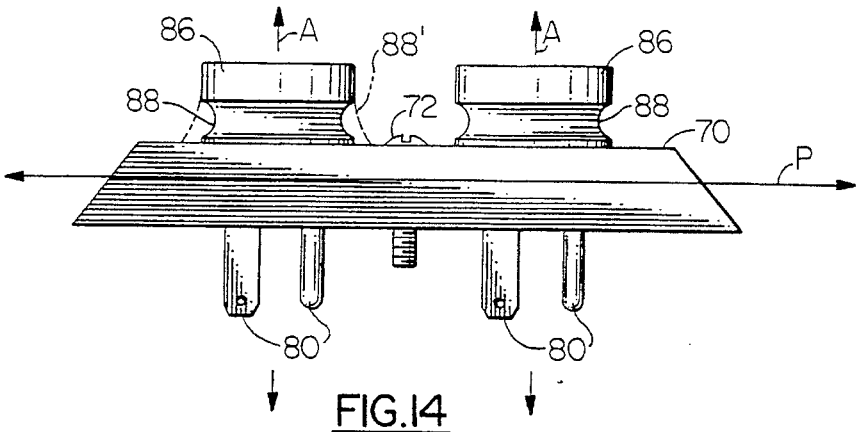
FIG. 14 is a diagrammatic left end view of a first embodiment of a face plate for an electrical outlet according to the present invention.
Figure 15:
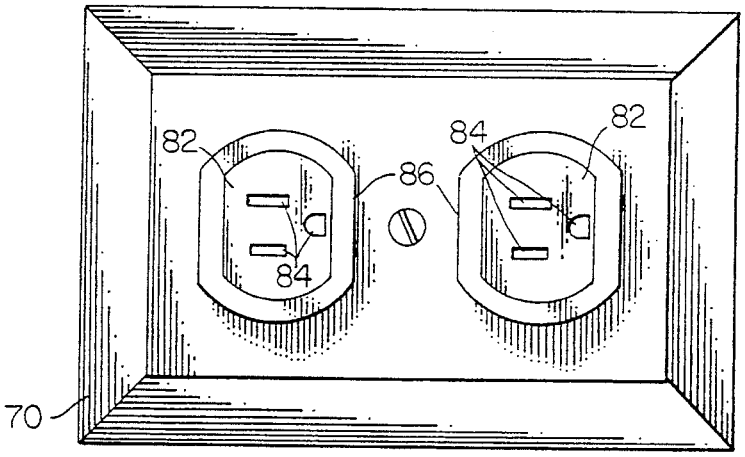
FIG. 15 is a front elevational view of the face plate of FIG. 14.
Figure 18:
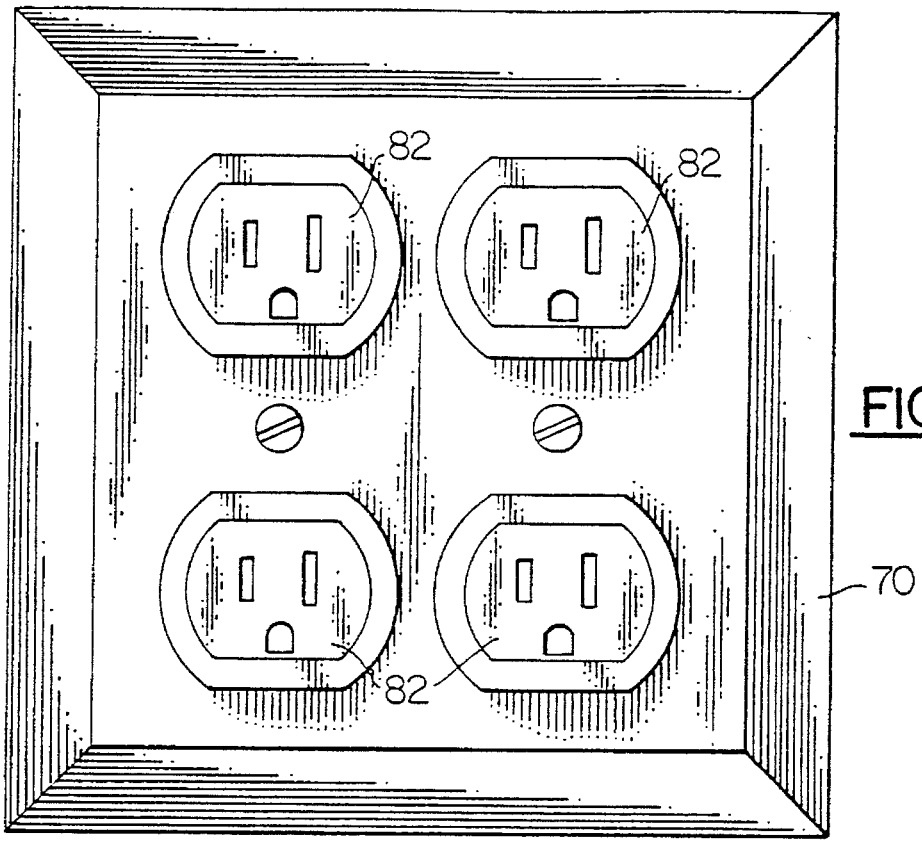
FIG. 18 is a diagrammatic representation showing a second embodiment of the face plate of FIG. 14.

FIG. 18 shows a slight variant of the face plate shown in FIGS. 14–16 in which the face plate is adapted to a be connected to a pair of side by side electrical outlets each having two receptacles, i.e. a face plate for a total of four receptacles.

Figure 19:
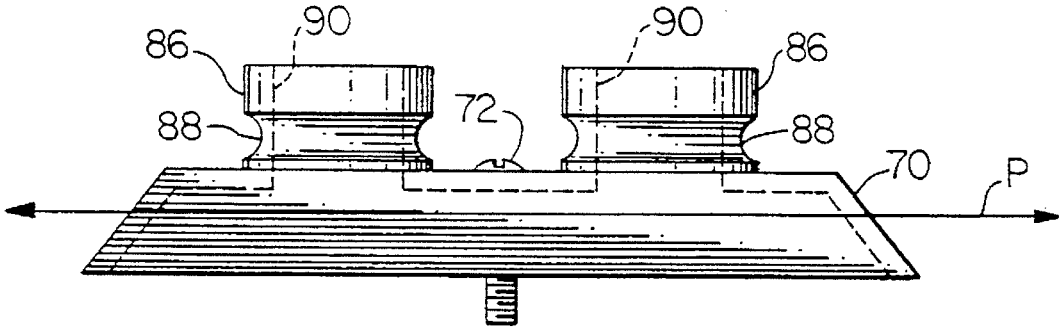
FIG. 19 is a diagrammatic left end view of a third embodiment of a face plate for an electrical outlet according to the present invention.
Figure 20:
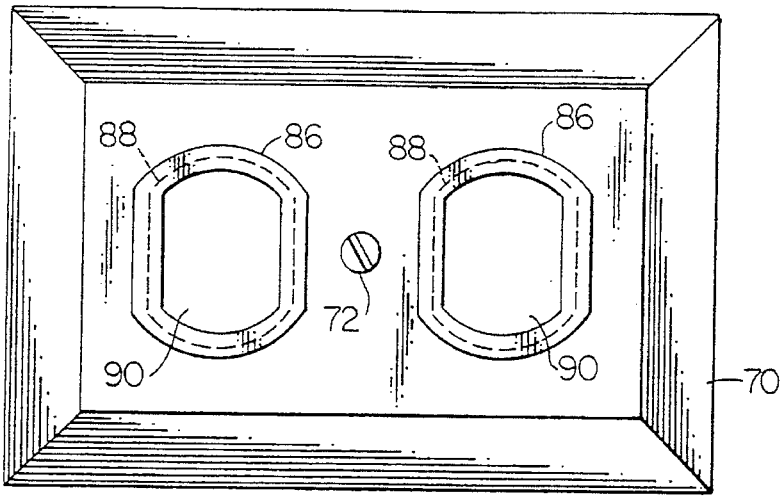
FIG. 20 is a front elevational view of the face plate of FIG. 19.
Figure 21:
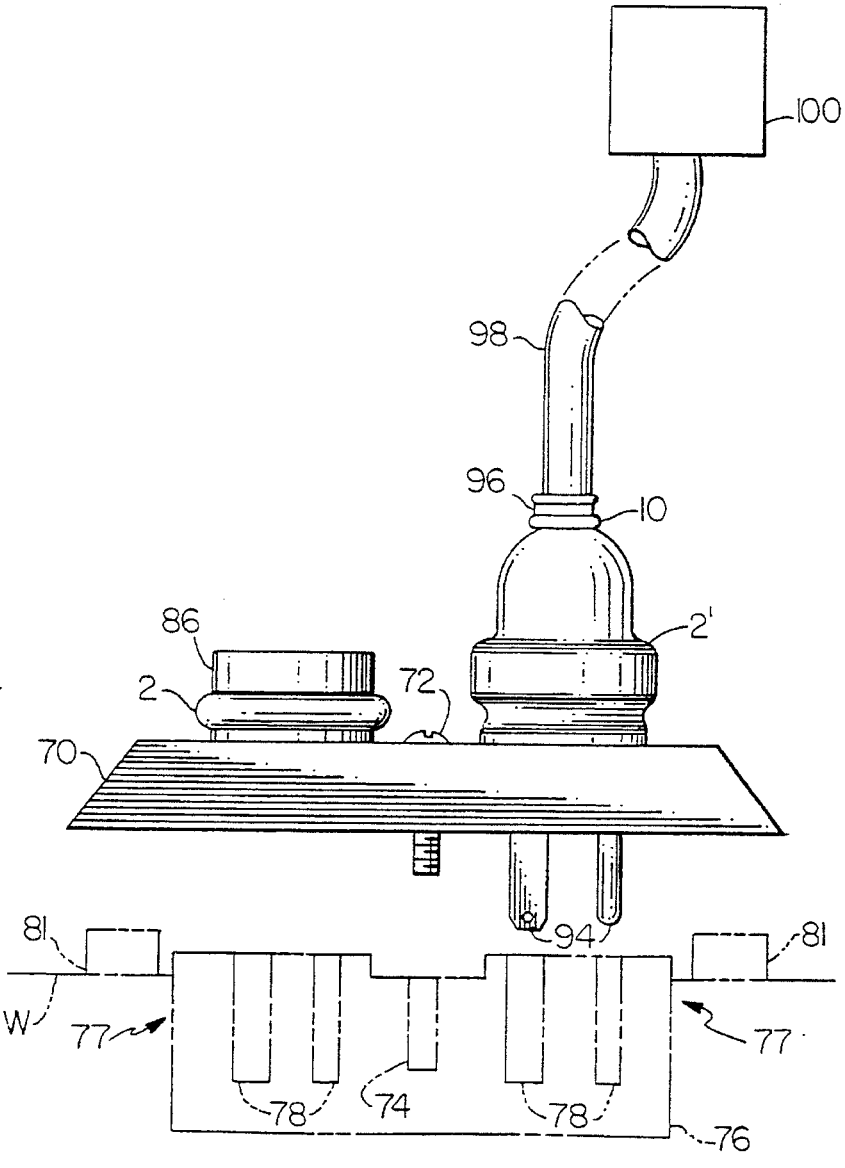
FIG. 21 diagrammatically shows operation of the face plate of FIG. 19.

Reference will now be had to FIGS. 19–21 in which a second embodiment of the face plate according to the present invention will now be discussed. As this embodiment is very similar to previously discussed embodiment, like elements are giving like reference numerals. The major difference between the second and first embodiments is that the intermediate member 82 has been eliminated in favor of a through hole or an aperture 90 extending completely through the boss 86. This enables the plug 96 of the electrical device 100 to pass through the boss 86 and directly engage, via its male contacts 94, the female contacts 78 of the receptacle 77. In this embodiment, the plug is at least partially accommodated within the through hole or aperture 90 of the boss 86, unlike the previous embodiment. Once the plug 96 is properly engaged with the receptacle 77, the tubular member 2 is then unrolled from the recess 88 over the boss 86 and the plug 96 to provide and maintain a secure engagement therebetween. If desired, the end portion of the tubular member remote from the recess 88 can be provided with a lip 10 to facilitate rolling and unrolling of the tubular member. When disconnection of the plug 96 from the receptacle 77 is desired, the tubular member 2 is rolled up and accommodated within the recess 88 so the plug 96 may be readily disconnected from the receptacle 77.

Figure 22:
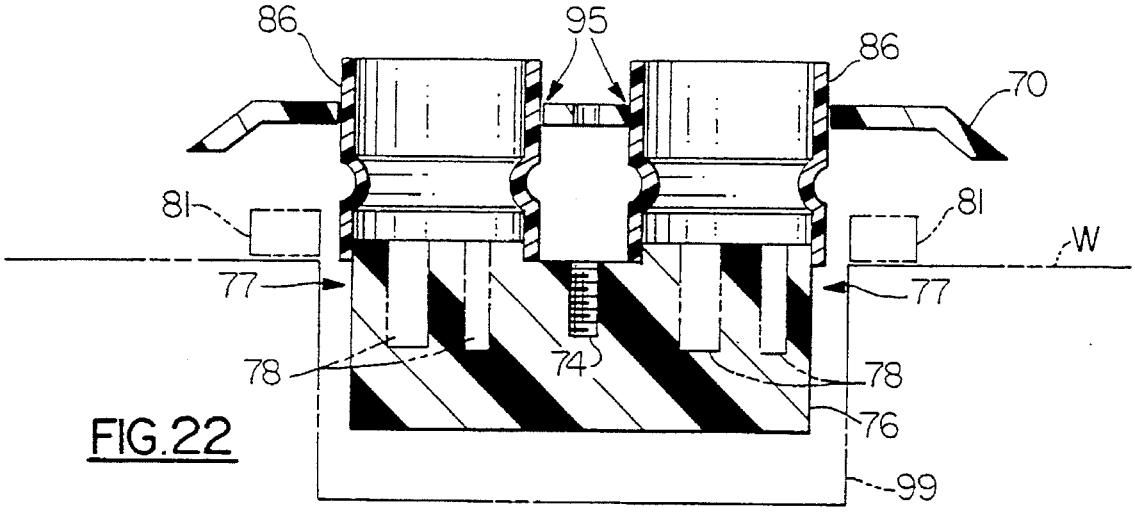
FIG. 22 shows diagrammatically shows a third embodiment for the face plate/electrical outlet arrangement of the present invention.

Turning now to FIG. 22, a third embodiment of the face plate/electrical outlet arrangement is shown. In this embodiment, the boss 86 is molded or integral formed as part of the receptacle 77 or attached directly thereto via glue, for example. The boss 86 is sized to pass through the aperture 95 of an presently available face plate 70, with a small clearance therebetween. Once the face plate 70 is securely attached to the electrical outlet 76, a tubular member 2 can then be rolled onto each boss 86 and used as described above. In this embodiment, the peripheral seal 81 may be eliminate as the bosses 86 are integral with the receptacle to prevent an leakage of moisture therebetween.

It is to be appreciated that the tubular member may be carried by the plug 96 of the electrical device 100. In such embodiment, the tubular member 2 is unrolled from the plug 96 over the exterior surface of the boss 86 to provide and maintain a secure engagement therebetween. If the exterior surface of the boss 86 is contoured, e.g. the dashed line 88' in FIG. 14, this facilitates and/or assists with rolling up of the tubular member 2 once the plug 96 and the boss 86 are to be disconnected from one another.

In all of the above described embodiments of FIG. 14–22, the electrical outlet 76 is suitable sealed, e.g. in a waterproof housing 99 (FIG. 22), with respect to the wall or other supporting member to prevent any liquid or moisture from contacting the receptacles 77 or the internal wiring of the electrical outlet. As such teaching well known in this art, further detailed discussion concerning the same is not provided herein.

Figure 23:
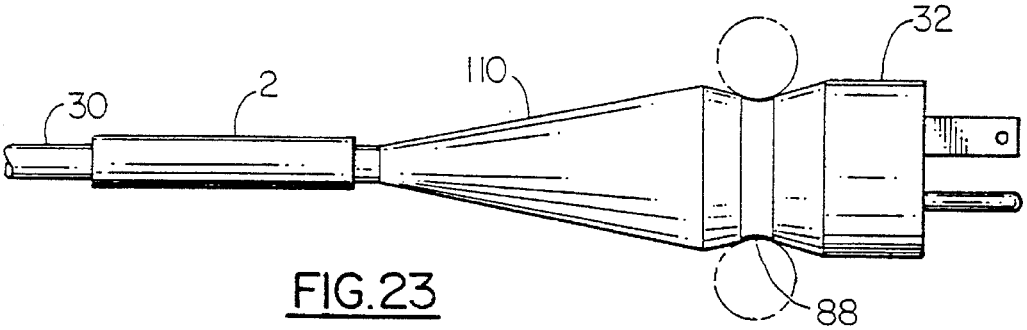
FIG. 23 is a diagrammatic representation showing an unrolled tubular member attached to an electrical cord having a male electrical connector at one end thereof.

FIG. 23 shows the male end of an electrical cord 30 which may have either a female electrical connection member or an electrical tool at the other end. The tubular member 2 encompasses the electrical cord 30 and is axially slidable therealong with a slight clearance therebetween. When use of the tubular member 2 is desired, the end of the tubular member remote from the male electrical plug 32 is rolled toward the electrical plug 32 and once the tubular member is completely rolled up into the "donut" configuration, further rolling of the tubular member occurs over incline surface 110 of the male electrical member to expand gradually the tubular member so that it may be received by annular recess 88 and properly located in a position ready for use. Once the male electrical connecting member 32 engages an appropriate female connecting member, the rolled up tubular member 2 is rolled from the male electrical connection member 32 onto the female electrical connection member and, once positioned on the female connection member at an appropriate location (i.e. at a position of about 2.54–5.08 mm (1–2 inches)), the tubular member is then unrolled in the direction toward the male connection member 32 so that, once completely unrolled, the tubular member is appropriately positioned over both the male and the female electrical connection to provide the waterproof and securing features of the present invention.

When disengagement of the electrical connection member is desired, the tubular member can be rolled from the female connection member on to the male electrical connection member and accommodated by the annular recess 88, or vice versa if the female connection member has an annular recess. Alternatively, the rolled up tubular member may be rolled onto the electrical cord 30 sufficiently away from the male electrical plug 32, i.e. about 10.16–15.24 mm (4–6 inches) depending upon the length of the tubular member, and thereafter unrolled on the electrical cord member, in the direction toward the male electrical plug 32, to return to its original unrolled position.

Figure 24:
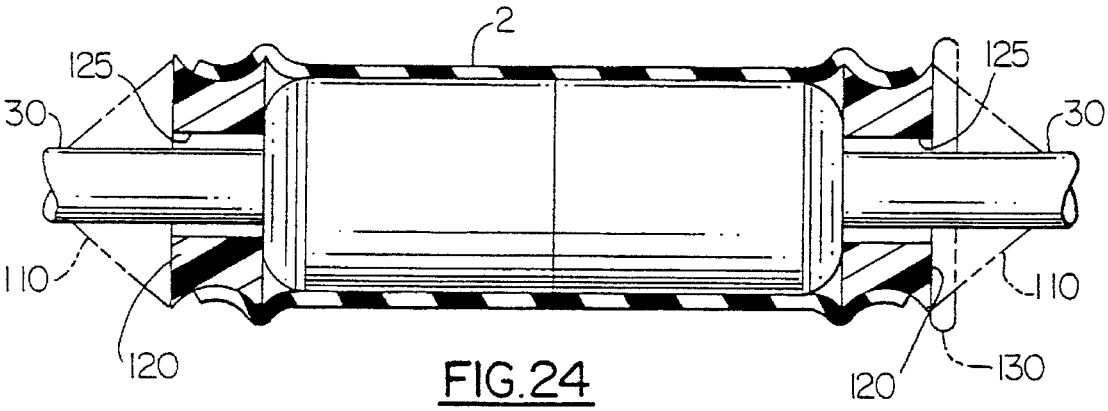
FIG. 24 show a support member, independent of the male and female electrical plugs, for supporting the tubular member when unrolled.

Turning to FIG. 24, each female and male connector connecting member may be provided with an annular support member 120 which is located adjacent the connection between the respective connection members and its electrical cord 30. The annular support member 120 may be slide on to the electrical cord 30 during manufacture of the cord or may comprise two mating pieces which snap together around the cord. Each annular support member 120 is provided with a central hole 125 and an annular recess 88 for accommodating the tubular member. When the tubular member is unrolled from one annular support member 120 to the other supporting member 120, as can be seen in FIG. 24, the two annular support members 120 and the tubular member interact with one another to maintain a secure engagement between the engaged connection members. When disengagement is desired, a portion of the tubular member is simply unrolled from one of the annular supporting members 120 to the other supporting member. If it is desired to prevent the tubular member from being rolled off the support member onto the electrical wire, an annular lip or a protrusion 130 may be provided for this purpose.

Finally, an inclined surface 110 may be provided to facilitate rolling of the tubular member onto and off the electrical cord 30 to store the tubular member in an unrolled storage position (see FIG. 24).

The tubular member of the present invention can be used to encase and provide a substantially waterproof connection between a variety of different interconnected members. For example, the tubular member may be used to encase two interconnected hydraulic members or may be used to interconnect a variety of mating electrical members in an automobile, e.g. spark plugs. Accordingly, the present invention has a wide field of use and application.

Talc, powder or other similar lubricating material may be applied to the exterior surface of the tubular member to assist with rolling and unrolling of the tubular member and prevent the tubular member from sticking to itself.

If the tubular member is manufactured from rubber latex or other similar materials, it is preferably coated with a protective outer coating, such as urethane, to prolong the life of the tubular member and improve its physical characteristics.

Since certain changes may be made in the above described tubular member, and apparatus for facilitating rolling and transferring of the same, without departing from the spirit and scope of the invention herein involved, it is intended that all subject matter contained in the above description and shown in the accompanying drawings shall be interpreted as being illustrative of the present invention and not limiting thereof.

Wherefore, we claim:

1. A method for achieving a substantially waterproof connection between first and second parts of a two part coupling, which are repeatedly connectable and disconnectable from one another, solely by the use of a resilient elongate tubular member formed from a single unitary piece of a substantially water impermeable material, said elongate tubular member having first and second opposed open ends, and said two part coupling can be used repeatedly in combination with said tubular member;

said method comprising the steps of:

placing said tubular member directly on only one of said first and said second parts of a two part coupling in a single rolled-up donut configuration;

interconnecting said first part with said second part;

unrolling said tubular member from one of said first and said second parts toward the other of said first and said second parts so that said first end of said tubular member encompasses a portion of one of said first and second parts and said second end of said tubular member encompasses a portion of the other of said first and second parts whereby abutting surfaces of said first and said second parts are completely encompassed by said tubular member and an inner surface of said tubular member immediately adjacent the abutting surfaces directly contacts an outer surface of said first and second parts such that said tubular member is resiliently expanded thereby minimizing penetration of a liquid between said tubular member and said first and second parts to achieve a substantially waterproof engagement therebetween.

2. A method of achieving a secure and substantially waterproof connection between a first part of a two part coupling, having a medium conveying conduit supported therein for facilitating the flow of a desired medium therethrough, and a second part of said two part coupling, having a medium conveying conduit supported therein for facilitating the flow of a desired medium therethrough, solely by using a resilient elongate tubular member in combination with said first and second parts, said tubular member being formed from a single unitary piece of a substantially water impermeable material and having first and second opposed open ends, wherein said two part coupling can be used repeatedly in combination with said tubular member;

said method comprising the steps of:

rolling said tubular member up into a rolled up donut configuration and supporting said rolled up tubular member directly on only one of said first and said second parts of a two part coupling;

interconnecting said first part with said second part so that the medium conveying conduits are connected with one another to allow the flow of the desired medium from one of said first and said second parts toward the other of said first and said second parts; and unrolling said rolled up tubular member from one of said first and said second parts toward the other of said first and said second parts so that an inner surface of said first end of said tubular member encompasses and directly contacts a portion of one of said first and second parts, an inner surface of said second end of said tubular member encompasses and directly contacts a portion of the other of said first and second parts, and an inner surface of said tubular member immediately adjacent abutting surfaces of said first and second parts directly contacts an outer surface of said first and second parts whereby the abutting surfaces of said first and said second parts are completely encompassed by said tubular member and at least said first and second ends of said tubular member are sufficiently resiliently expanded so that the engagement between said inner surface of said tubular member and an exterior surface of said first and second parts solely minimizes penetration of a liquid and achieves a substantially waterproof engagement therebetween.

3. A method according to claim 2, further comprising the step of allowing a desired quantity of the medium to flow through the medium conveying conduits from one of said first and said second parts toward the other of said first and said second parts.

4. A method according to claim 3, further comprising the step of, once a desired quantity of the medium has flowed through the medium conveying conduits, rolling one end of said tubular member from one of said first and said second parts toward the other of said first and said second parts so that said tubular member is again rolled up into a single donut configuration and directly supported by only one of said first and said second parts and, thereafter, disconnecting said first and said second parts from one another.

5. A method according to claim 3, wherein each of said first and second parts has a head portion connected to an outer casing with the outer casing having a smaller exterior perimeter than an exterior perimeter of said head portion, and said method further comprising the step of, when unrolling said rolled up tubular member from one of said first and said second parts toward the other part, unrolling said tubular portion only over the head portions of said first and second parts.

6. A method according to claim 5, wherein the step of rolling said tubular member up into a rolled up donut configuration comprises the step of initially placing said tubular member on an outer casing of one of said first and said second parts in an unrolled elongate configuration and, thereafter, rolling said tubular member into a single rolled-up donut configuration.

7. A method according to claim 3, further comprising the step of forming said first open end of said elongate tubular member with an inner perimeter smaller than an exterior perimeter of said first part and forming said second open end of said elongate tubular member with an inner perimeter smaller than an exterior perimeter of said second part whereby said first open end is resiliently expanded when said first open end encompasses the portion of said first part and said second open end is resiliently expanded when said second open end encompasses the portion of said second part thereby to form a substantially waterproof connection therebetween and minimize the possibility of said first and said second parts becoming disconnected from one another when a disconnecting force is applied to one of said first and said second parts.

8. A method according to claim 3, further comprising the step of providing an exterior surface of said tubular member with a plurality of axially extending and spaced reinforcing means for minimizing axial stretching of said tubular member, when a disconnecting force is applied thereto, while allowing resilient expansion of said tubular member, and manufacturing said tubular member from a material having different properties from the properties of a material used as said reinforcing means.

9. A method according to claim 3, further comprising the step of stretching said tubular member to between 10 and 100 percent when encompassing said first and second parts with said tubular member, and providing an exterior surface of said tubular member with a lubricating material to facilitating rolling and unrolling of said tubular member.

10. A method according to claim 3, further comprising the step of using said tubular member in combination with an apparatus for facilitating rolling of said tubular member into a rolled up configuration, said apparatus comprising an elongate tubular portion having an axial length at least substantially as long as the axial length of said tubular member to be rolled up, and said tubular portion having an outer dimension substantially equal to an inner dimension of one of said first and said second portions of said tubular member to be rolled up.

11. A method according to claim 3, further comprising the step of coating said tubular member with a coating to protect and prolong the useful life of said tubular member.

12. A method according to claim 3, further comprising the step of providing both said first and said second parts with an annular support portion having an annular recess therein for accommodating one end of said tubular member; and supporting said rolled up tubular member via said annular recess of one of said first and said second parts.

13. A method according to claim 3, further comprising the step of manufacturing said tubular member from a material selected from the group consisting of vinyl plastisol, polyvinyl chloride, nitrile latex, rubber latex, acrylic latex, liquid neoprene, butyl rubber, a thermoplastic rubber compound, a thermoplastic rubber elastomer, a thermoset plastic, a plastic, a polypropylene, a plasticizer, silicone and urethane.

* * * * *